US007283640B2

(12) United States Patent
Karamuk

(10) Patent No.: US 7,283,640 B2
(45) Date of Patent: Oct. 16, 2007

(54) MICROPHONE COVER

(75) Inventor: Erdal Karamuk, Meilen (CH)

(73) Assignee: Phonak AG, Stafa (CH)

( * ) Notice: Subject to any disclaimer, the term of this patent is extended or adjusted under 35 U.S.C. 154(b) by 612 days.

(21) Appl. No.: 10/775,644

(22) Filed: Feb. 10, 2004

(65) Prior Publication Data

US 2005/0175203 A1 Aug. 11, 2005

(51) Int. Cl.
*H04R 25/00* (2006.01)

(52) U.S. Cl. ..... 381/322; 381/324

(58) Field of Classification Search ..... 381/320, 381/324, 325, 328, 330, 380, 382, 391, 189, 381/355, 359, 360; 181/129, 130, 135, 149
See application file for complete search history.

(56) References Cited

U.S. PATENT DOCUMENTS 4,972,488 A * 11/1990 Weiss et al. ..... 381/325
6,512,834 B1 * 1/2003 Banter et al. ..... 381/386
6,795,562 B1 * 9/2004 Gunnersen et al. ..... 381/325
6,932,187 B2 * 8/2005 Banter et al. ..... 181/149

* cited by examiner

*Primary Examiner*—Huyen Le
(74) *Attorney, Agent, or Firm*—Pearne & Gordon LLP

(57) ABSTRACT

The inventive microphone cover for hearing devices for at least partially covering openings (6) arranged at the outside of the hearing device comprises a ring (2) with racks (4) overdrawing the opening of the ring (2). The outer diameter of the ring (2) thereby is equivalent with the inner diameter of the corresponding opening (6) of the hearing device such as the ring (2) is at least partly insertable within the opening (6). A stop (11) is provided advantageously within the opening (6) at a desired depth (t) to define the exact insertion position of the microphone cover (1).

28 Claims, 4 Drawing Sheets

MICROPHONE COVER

BACKGROUND OF THE INVENTION

This invention relates to a Microphone cover for hearing devices for at least partially covering openings arranged at the outside of the hearing devices and to a hearing device with openings arranged at the outside of the hearing device with a microphone cover.

It is to be noted that the term hearing devices shall cover as well hearing aids, such as behind-the-ear hearing aids and in-the-ear hearing aids.

Hearing devices comprise at least one microphone for the receiving and amplification or eventually reduction of sound events. This microphone is exposed to different environmental influences, such as humidity, sweat and cerumen. Actuating elements such as switches or volume controls are arranged in the direct vicinity of the microphones of miniaturized hearing devices, such as in-the-ear hearing-aids. Dirt in form of particles may thus be disposed by the fingers of the wearer of the hearing device in the area of the microphone opening. This will lead to a plugging of such openings and thus at least to a reduction or finally to an elimination of the sound receiving capability of the microphone. The involved hearing devices will subsequently have to be cleaned or the microphone will have to be replaced, which may as a rule only be performed by skilled professionals and generate additional costs. The reduction or failure of the microphones will be appreciated as low quality of the overall hearing device and thus constitute a bad image of the hearing devices concerned.

A number of solutions for the covering of microphones are well known. A lot of hearing devices have coverings for the microphone openings firmly integrated or glued within the battery cap or the faceplate or the module. They will have to be cleaned in an extensive manner in case of pollution.

U.S. Pat. No. 4,987,587 discloses a covering cap for the protection of openings leading to the outside of hearing aids among others. The cap thereby will be attached over the opening of the device concerned and consist of openings, which are covered by a membrane. The disclosed construction conditionally requires a coupling element protruding from the shell to the outside of the hearing device, onto which the cap will be snapped on. Such a coupling element may on one hand be optically disturbing and on the other hand be susceptible for the collection of dirt due to its edges. Such a cap furthermore risks to unintentionally or independently loosen and thereby will get lost or intrudes into the ear canal. The document furthermore only teaches the covering of openings of hearing devices directed to the ear, e.g. the sound outlet openings of hearing devices. The outlet openings of the hearing device will thereby be protected, but not the sound entry opening of the microphone directed to the outside of the ear.

A covering for the sound entry opening for in-the-ear hearing aids is further disclosed in DE 20208601 U1, consisting of an open plastic ring with plastic gauze stretched over the opening, thus providing a cover of the microphone impermeable for cerumen. This covering provides only small form stability and may therefore build up a gap between the cover and the opening susceptible for dirt and humidity.

WO97/09864 discloses a further device for covering the openings directed to the ear of hearing devices. The respective openings will be closed by porous plugs, which are plugged into the openings or the channels corresponding to the openings respectively. A disadvantage of this construction lies in the fact that the plug may practically no longer be removed out of the opening or the channel. Thus the plug only may be cleaned together with the hearing device, thereby remaining within the opening or the channel. A further problem relates to the possibility of pushing the plug too far into the opening or channel respectively, thereby forming again an open chamber susceptible for the deposition of dirt and thus closing the respective openings.

SUMMARY OF THE INVENTION

It is an object of the present invention to provide a cover for openings of hearing devices, which is easy to assemble, provides a reliable protection against dirt and humidity and which is easy to be removed or replaced where required.

The present invention provides a microphone cover for hearing devices for at least partially covering openings arranged at the outside of the hearing device, comprising a ring with racks overdrawing the opening of the ring, whereby the outer diameter of the ring is nearly equivalent with the inner diameter of the corresponding opening of the hearing device, such as the ring is at least partly insertable within the opening. Thus, no connecting elements protruding from the surface of the hearing device for the attachment of the microphone cover are necessary. A high form stability of the ring is ensured by the racks, thus building a firm connection between the outside of the ring and the contact surface of the opening which is closed for dirt and/or humidity.

In one embodiment the ring consists of a substantially circular flat disk with a centrally arranged opening. The microphone cover may thus be easy inserted into the corresponding opening of the hearing device. The ring preferably consists of a tapered or rounded brink directed to the outside of the hearing device in its fitted state. This is an optimal shape to the outside of the hearing device, preventing dirt of being anticipated or deposited at this area.

In another embodiment at least three racks are arranged in regular distance to each other and are coupled together in the centre area of the ring. This arrangement, looking like a spoke wheel, has a good balance between stiffening the shape of the ring and remaining openings for the transfer of the sound to the microphone. It is clear that an arrangement with only one rack, dividing the opening of the ring in two sections, or more than three racks, thereby reducing the area of the remaining openings to complicate the entering of dirt or humidity, is possible as well.

In another embodiment, the bars are convex curved to the outside of the ring in its fitted state. The microphone cover thereby provides an overall curved shape to the outside, which optically matches the general shape of the hearing device and further reduces the risk of deposition of dirt.

In another embodiment the microphone cover consists of a one piece plastic. The microphone cover may thus be easily and in a cost saving matter manufactured. Preferably, the microphone cover is manufactured in injection molding technique.

In another embodiment the ring or the racks respectively are connected directly with a bar-shaped tool. The microphone cover having very small dimension therefore may easily be manually inserted into the opening of the hearing device, especially of in-the-ear hearing devices.

In another embodiment, said tool is connected over at least one bridge with the ring or the racks respectively, whereby the bridge is provided as predetermined breaking point. The tool thus may be easily separated from the microphone cover after its insertion into the hearing device by breaking up the bridge. This may be accomplished by bending or twisting the bridge with only little effort. The microphone cover thereby remains in its corresponding opening within the hearing device.

In another embodiment, the ring, the racks and the tool consist of one single piece. This single piece may preferably consist of plastic manufactured by injection molding.

In another embodiment, the end of the tool opponent to the ring is provided as a holding device or fork. This end of the tool may therefore be used to remove a microphone cover inserted within the hearing device. Preferably, the holding device consists of two resiliently arranged fingers with locking means. The fingers may be slid over a rack of the microphone cover and thereby engaging the rack. The microphone cover may then be pulled out of the hearing device or opening respectively by moving the tool away from the hearing device. That points out the advantage of the racks of the inventive microphone cover, which additionally to its other benefits allows an easy removing of the microphone cover without any damage of the ring.

In another embodiment, the ring is provided with flanges protruding to its center. Those flanges serve as a holder or fixing element for disc shaped elements to be positioned in the area of the opening of the microphone cover.

In another embodiment, the surface of the microphone cover is at least partly covered with a hydrophobe coating. The entering of fluids will be prevented by such a coating both a direct entering through the opening of the microphone cover and an indirect entering through the gap between the microphone cover and the hearing device.

In another embodiment, a filter is arranged at the inside of the ring, preferably provided as a circular disk covering the opening of the ring. Such a filter prevents for the intruding of particles into the opening of the hearing device, especially for particles that are smaller than the remaining opening between the ring and the rack.

In another embodiment the filter is attached firmly or detachable to the ring. Preferably, the filter is glued to the ring or is shifted or snap locked within the ring. Thus, the filter may be removed only together with the microphone cover or may be removed separately in case of pollution with dirt.

In another embodiment, the filter consists of metal wire or natural or synthetic fabrics. The wire or fabrics are arranges such that spaces are provided between the single wires or fabrics.

In another embodiment the filter consists of a fleece consisting of natural or synthetic fabrics. The sound will pass through the fleece to the microphone, but dirt particles or humidity will be reliably blocked out.

In another embodiment the filter consists of a sinter body made out of metal, plastic or ceramic.

Another embodiment of the invention provides a hearing device with openings arranged at the outside of the hearing device, with a microphone cover comprising a ring with racks overdrawing the opening of the ring, whereby the outer diameter of the ring is nearly equivalent with the inner diameter of the corresponding opening of the hearing device, and further comprising stop means in the inside of the opening to limit the insertion depth of the ring. The stop means prevent reliably the insertion of the microphone cover further than intended or an independent or unintended displacement of the microphone cover during the operation of the hearing device or hearing aid respectively. Preferably, a microphone is arranged within the hearing device and connected by a channel with the opening.

In another embodiment, the stop means are arranged at a depth in relation with the opening that is equal or smaller then the external extend of the microphone cover. Thus the microphone cover may be inserted to be aligned close with the opening or to protrude a small amount out of the rim of the opening. Thereby, no dirt particles may be collected in a cavity on top of the microphone cover and thus plugging the microphone cover.

In another embodiment, the inside surface of the opening is at least partially rough to provide a friction joint with the corresponding surface of the microphone cover. An unintentional loosing of the microphone cover may thus be reliable prevented resulting in a possible loss of the microphone cover.

In a further embodiment of the invention, there is claimed the use of such a microphone cover in hearing devices or hearing aids or in-the-ear hearing devices for the covering of openings of microphones.

It is to be understood that such an inventive microphone cover is not only suitable for the covering of openings of hearing devices or hearing aids leading to microphones, but also for other openings, such as the ventilation openings.

DESCRIPTION OF THE DRAWINGS

For purpose of facilitating and understanding of the invention, there is illustrated in the accompanying drawings preferred embodiments thereof to be considered in connection with the following description. Thus the invention may be readily understood and appreciated.

DESCRIPTION OF A PREFERRED EMBODIMENT

Figure 1:
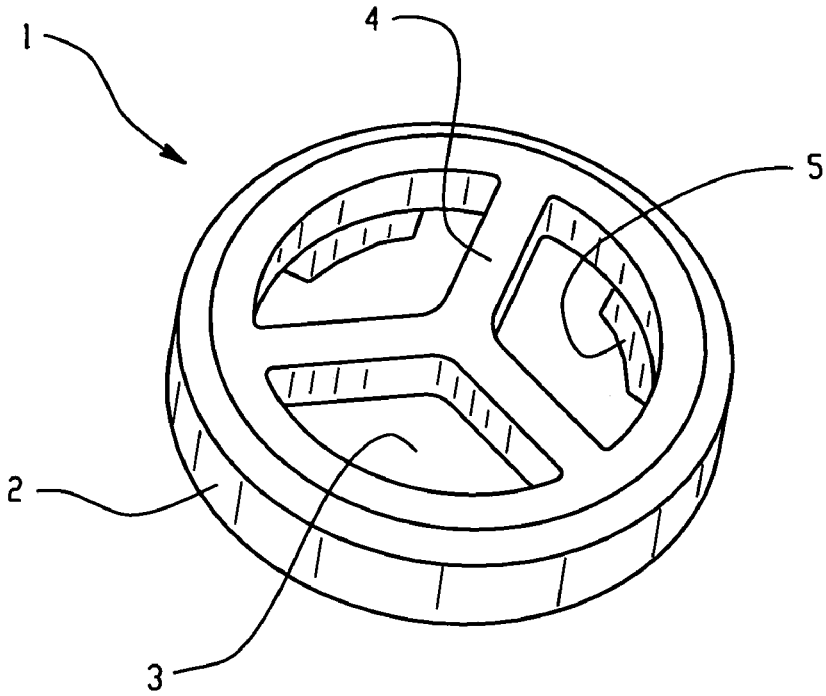
FIG. 1 is a view of an inventive microphone cover.

Referring to FIG. 1, an inventive microphone cover 1 is shown. It consists essentially of a ring 2 with racks 4 directed to the center and connected together in the center of ring 2 such as spokes of a wheel. Openings 3 are formed between the ring 2 and the racks 4. The ring 2 and the racks 4 are for instance provided as a single piece element and consist of plastic. Such an element may be easy and cost effective manufactured as an injection molded element.

Figure 2:
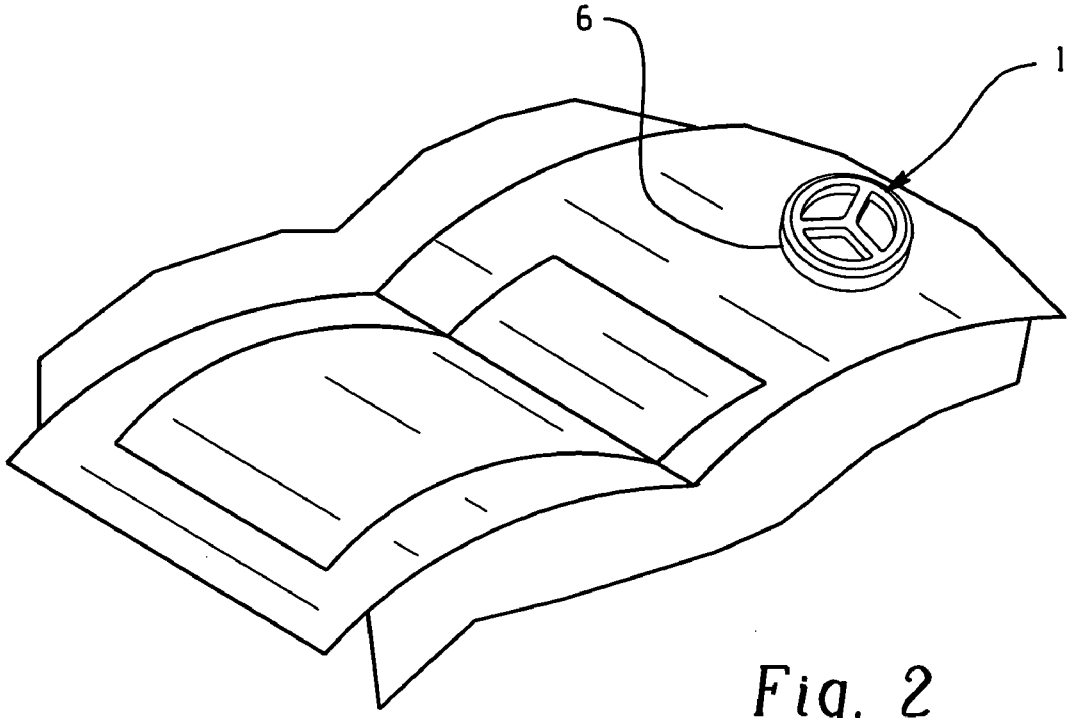
FIG. 2 is a schematically view of an area of a hearing device with a microphone cover inserted.

The racks 4 are curved convex to the centre of the ring 2 and therefore adapted to the contour of the hearing device, as shown in FIG. 2.

The microphone cover 1 is inserted into the opening 6 of the hearing device, whereby the upper edge of the ring 2 is slightly protruding to the outside or closes firm with the surface of the hearing device in this area. The exact position of the microphone cover 1 is achieved by a stop provided within the opening 6 at a predetermined depth. Thus, the microphone cover 1 may not be pushed further into the opening 6 as to its predetermined depth, neither intentionally nor unintentionally.

This leads on one hand to a well defined positioning of the microphone cover and thus to a uniform optical impression and on the other hand to constant acoustic circumstances.

The diameter of the opening 6 is dimensioned such as a frictionally connection between the opening 6 and the outside surface of the ring 2 is provided. Thus the microphone cover 1 is held and fixed reliable within the opening 6 and may not loosen unintentionally or independently. This frictionally connection results from respective dimensions of the opening 6 and the microphone cover 1 and may be supported by appropriate surface conditions of the adjacent surfaces.

It is clear that any other suitable detachable connection between the microphone cover 1 and the opening 6 may be used, for instance a snap or locking connection.

Figure 3:
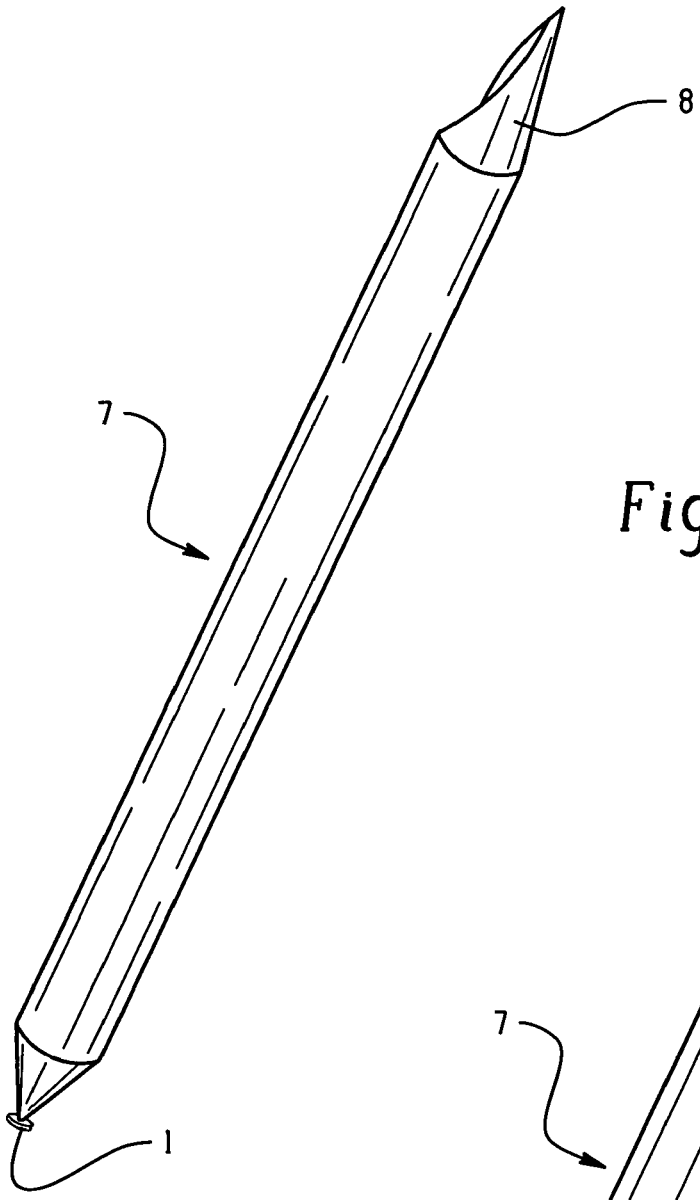
FIG. 3 the view of a microphone cover according FIG. 1 with a tool attached to it.

An appropriate tool 7 is connected to the microphone cover 1 to insert the microphone cover 1 into the opening 6, as shown in FIG. 3. The tool 7 is provided as a pen and therefore be easily manageable. The other end of the pen 7 may consist of a gripper or a fork.

Figure 4:
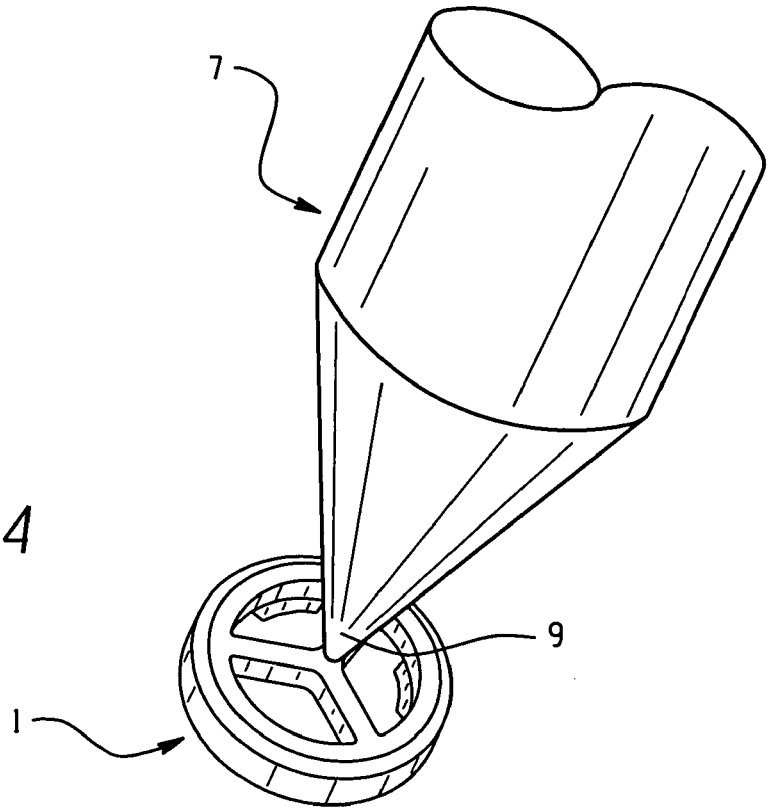
FIG. 4 more detailed the tip of the tool of FIG. 3.

One end of the tool 7 is connected over a thin bridge 9 to the microphone cover 1, as shown in detail in FIG. 4. This bridge 9 is preferably built as a predetermined breaking point, e.g. it may be separated under applying only a small force, as for instance by turning the tool 7 around its longitudinal axis.

The microphone cover 1 is easily insertable into the opening 6 of the hearing device due to its integrated tool 7. This may be done without the need of any professional skill and may thus be performed by the wearer of the hearing device himself. As soon as the microphone cover is in its position, the bridge 9 may be separated by turning or twisting of the tool 7.

Figure 8:
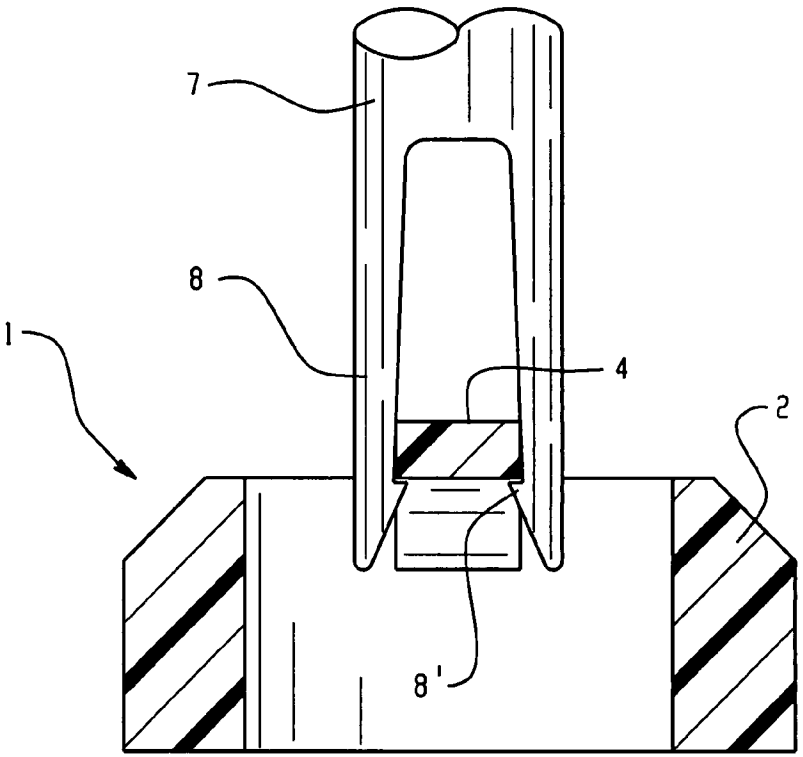
FIG. 8 a cross sectional view of a microphone cover with the tool according FIG. 3 snapped over a rack of the microphone cover.

If the microphone cover 1 has to be replaced, the same tool 7 may be used to remove the inserted microphone cover 1 out of the hearing device. The other end 8 of the tool 7 is therefore provided with a fork. The fork may consist of two resilient fingers 8 with snap locking means 8', which may be inserted over a rack 4 of the microphone cover 1, as shown in FIG. 8. By pulling away of the tool 7 from the hearing device the microphone cover 1 may be pulled out of its corresponding opening 6 and subsequently a new microphone cover 1 may be inserted within this opening 6.

For this operation, the original tool 7 or the tool 7 of the new microphone cover 1 may be used.

The inventive microphone cover 1 may be inserted and replaced easily even by not professionally skilled people, for instance by the wearer of the hearing aid himself, due to its racks 4 despite the extreme small dimensions of the microphone cover 1 for use in in-the-ear hearing aids. The service intervals of hearing devices may for instance be extended with respect to common solutions, as the microphone itself is protected by the microphone cover and this cover is easily replaceable, thus leading to a reduction of the overall costs.

The microphone cover 1 may be additionally equipped with a filter in the area of the openings 3 of the microphone cover 1. Such a filter will additionally protect from the penetration of dirt and humidity into the inside of the hearing device and especially to the microphone arranged within the hearing device.

Figure 5:
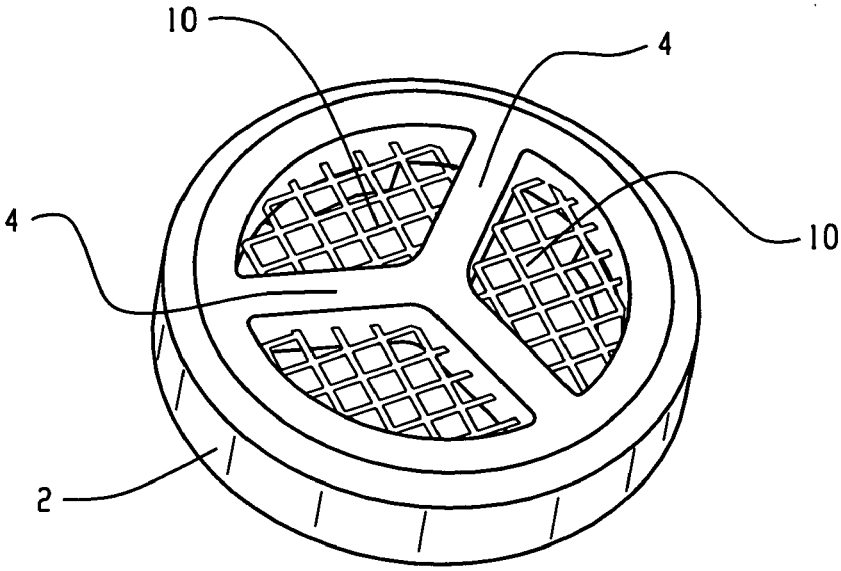
FIG. 5 the view of an inventive microphone cover with an attached filter element.

Such a filter 10 may be attached at the inside of the ring 2, as shown in the view of FIG. 5. The filter 10 may for instance consist of a circular, flat body, which is attached at the inside of ring 2 or which is pressed onto the racks 4 by means of the flanges 5, as shown in FIG. 1.

The filter 10 may consist of a coarse meshed texture out of metal wire or synthetic fabrics. Alternatively, a fleece may be used, which may consist as well of naturally or synthetic fabrics. Furthermore, the filter 10 may consist of a porous sinter body consisting of metal, plastic, or ceramic.

The ring 2 of the microphone cover 1 serves as carrier for the filter 10. The filter 10 may be firmly attached to the ring 2, for instance by gluing, or may be mechanically fixed to the ring 2. This may be provided by friction forces at the inside of the ring 2 and/or by use of the flanges 5, which are arranged at the inside of the ring 2 and press the filter 10 against the racks 4.

Figure 6:
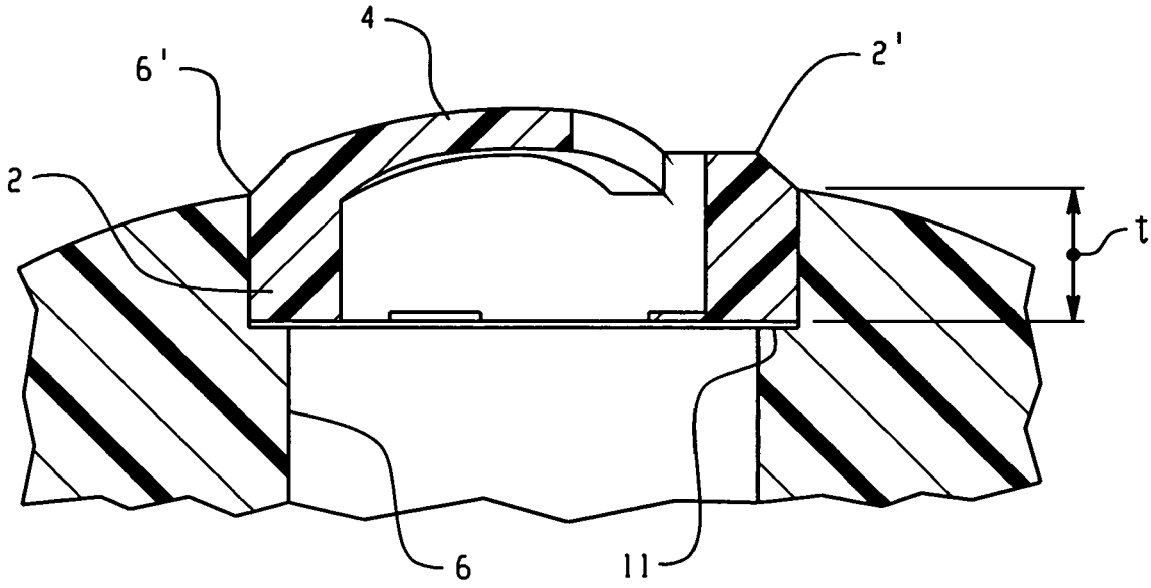
FIG. 6 a cross sectional view of the area of a microphone cover inserted within the hearing device.

FIG. 6 is showing the cross sectional view of a hearing device in the area of the microphone cover 1 inserted within the opening 6. The opening 6 comprises a step 11 at a depth t from the rim 6' of the opening 6 serving as a stop for the ring 2 of the microphone cover 1. This stop defines the maximum or desired insertion depth of the microphone cover 1 within the opening 6 or the hearing aid respectively. The depth t has preferably a size equivalent to the height of the ring 2 of the microphone cover 1, so as to match close with the rim 6' of the opening 6 and thus no edge or cavity is built to collect dirt or humidity.

Figure 7:
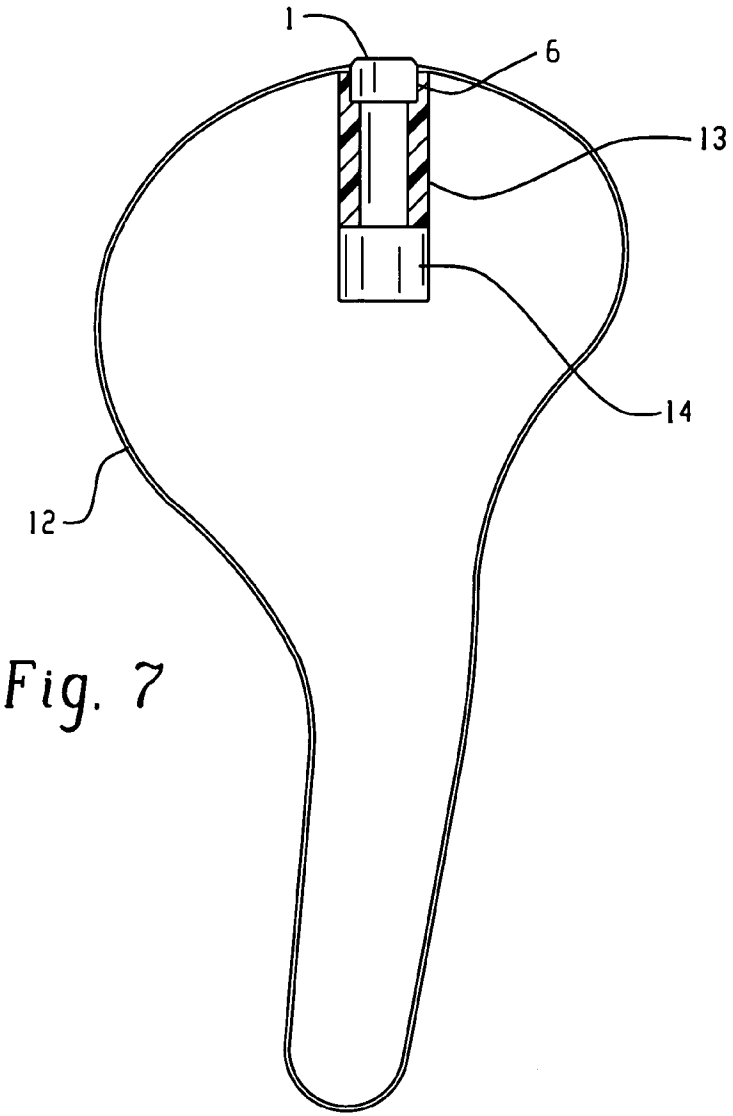
FIG. 7 a schematically cross sectional view of an inventive hearing device with microphone cover.

FIG. 7 is showing schematically the cross sectional view of the shell 12 of a hearing device with the microphone cover 1 inserted within the opening 6. The opening 6 is followed by a channel 13 which leads to the microphone 14 arranged within the shell 12 of the hearing device. The other elements or electronic components respectively arranged within the shell 12 of the hearing device are suppressed in FIG. 7 due to a better overview.

I claim:

1. Microphone cover for hearing devices for at least partially covering openings arranged at the outside of the hearing device, comprising a ring with racks overdrawing the opening of the ring, whereby the outer diameter of the ring is nearly equivalent with the inner diameter of the corresponding opening of the hearing device, and the ring is at least partly insertable within the opening.

2. Microphone cover according to claim 1, wherein the ring (2) consists of a substantially circular flat disk with a centrally arranged opening.

3. Microphone cover according to claim 1, wherein the ring (2) consists of a tapered or rounded brink (2') directed to the outside of the hearing device in its fitted state.

4. Microphone cover according to claim 1, wherein at least three racks (4) are arranged in regular distance to each other and are coupled together in the centre of the ring (2).

5. Microphone cover according to claim 1, wherein it consists of a one piece plastic.

6. Microphone cover according to claim 1, wherein it is made in injection molding technique.

7. Microphone cover according to claim 1, wherein the ring (2) or the racks (4) respectively are connected directly with a bar-shaped tool (7).

8. Microphone cover according to claim 7, wherein the tool (7) is connected over at least one bridge (9) with the ring (2) or the racks (4) respectively, whereby the bridge (9) is provided as predetermined breaking point.

9. Microphone cover according to claim 7, whereby the end of the tool (7) opponent to the ring (2) is provided as a holding device or fork.

10. Microphone cover according to claim 1, wherein the ring (2) is provided with flanges (5) protruding to its center.

11. Microphone cover according to claim 1, wherein the surface is at least partly covered with a hydrophobe coating.

12. Microphone cover according to claim 1, wherein a filter is arranged at the inside of the ring, and provided as a circular disk covering the opening of the ring.

13. Microphone cover according to claim 12, wherein the filter (10) is attached firmly or detachable to the ring (2).

14. Microphone cover according to claim 13, wherein the filter (10) is glued to the ring (2).

15. Microphone cover according to claim 13, wherein the filter (10) is shifted or snap locked within the ring (2).

16. Microphone cover according to claim 12, wherein the filter (10) consists of metal wire or natural or synthetic fabrics.

17. Microphone cover according to claim 12, wherein the filter (10) consists of a fleece consisting of natural or synthetic fabrics.

18. Microphone cover according to claim 12, wherein the filter (10) consists of a sinter body made out of metal, plastic or ceramic.

19. Use of a microphone cover according to claim 1 in hearing devices or hearing aids or in-the-ear hearing devices for the covering of openings (6) of microphones.

20. Microphone cover according to claim 1, wherein the ring is insertable into the opening from the outside of the hearing device.

21. Microphone cover for hearing devices for at least partially covering openings arranged at the outside of the hearing device, comprising a ring with racks overdrawing the opening of the ring, whereby the outer diameter of the ring is nearly equivalent with the inner diameter of the corresponding opening of the hearing device, as and the ring is at least partly insertable within the opening, wherein the racks are convex curved to the outside of the ring in its fitted state.

22. Microphone cover for hearing devices for at least partially covering openings arranged at the outside of the hearing device, comprising a ring with racks overdrawing the opening of the ring, whereby the outer diameter of the ring is nearly equivalent with the inner diameter of the corresponding opening of the hearing device, as and the ring is at least partly insertable within the opening, wherein the ring or the racks respectively are connected directly with a bar-shaped tool, wherein the tool is connected over at least one bridge with the ring or the racks respectively, whereby the bridge is provided as predetermined breaking point, and, wherein the ring, the racks and the tool consist of one piece.

23. Microphone cover according to claim 22, wherein the one piece consist of plastic manufactured by injection molding.

24. Microphone cover for hearing devices for at least partially covering openings arranged at the outside of the hearing device, comprising a ring with racks overdrawing the opening of the ring, whereby the outer diameter of the ring is nearly equivalent with the inner diameter of the corresponding opening of the hearing device, as and the ring is at least partly insertable within the opening, wherein the ring or the racks respectively are connected directly with a bar-shaped tool, whereby the end of the tool opponent to the ring is provided as a holding device or fork, wherein the holding device consists of two resiliently arranged fingers with locking means.

25. Hearing device with openings (6) arranged at the outside of the hearing device, with a microphone cover (1) comprising a ring (2) with racks (4) overdrawing the opening of the ring (2), whereby the outer diameter of the ring (2) is equivalent with the inner diameter of the corresponding opening (6) of the hearing device, and further comprising stop means (11) in the inside of the opening (6) to limit the insertion depth of the ring (2).

26. Hearing device according to claim 25, wherein a microphone (14) is arranged within the hearing device and connected by a channel (13) with the opening (6).

27. Hearing device according to claim 25, wherein the stop means are arranged at a depth (t) in relation with the opening (6) that is equal or smaller then the external extend of the microphone cover (1).

28. Hearing device according to claim 25, wherein the inside surface of the opening (6) is at least partially rough to provide a friction joint with the corresponding surface of the microphone cover (1).

* * * * *